US008256254B2

(12) United States Patent
Bellamy

(10) Patent No.: US 8,256,254 B2
(45) **Date of Patent: *Sep. 4, 2012**

(54) LOCK PORTION WITH SOLID-STATE ACTUATOR

(75) Inventor: Dirk L. Bellamy, Salem, OR (US)

(73) Assignee: UTC Fire & Security Americas Corporation, Inc., Bradenton, FL (US)

( * ) Notice: Subject to any disclaimer, the term of this patent is extended or adjusted under 35 U.S.C. 154(b) by 561 days.

This patent is subject to a terminal disclaimer.

(21) Appl. No.: 11/965,094

(22) Filed: Dec. 27, 2007

(65) Prior Publication Data

US 2009/0165512 A1 Jul. 2, 2009

(51) Int. Cl.
*E05B 49/00* (2006.01)

(52) U.S. Cl. ..... 70/278.7; 70/277; 70/278.3; 70/283.1

(58) Field of Classification Search ..... 70/277, 70/278.2, 278.3, 278.7, 279.1, 283, 283.1
See application file for complete search history.

(56) References Cited

U.S. PATENT DOCUMENTS

| | | | | |
|---|---|---|---|---|
| 3,095,726 | A | 7/1963 | Schlage | |
| 3,782,143 | A | 1/1974 | Schlage | |
| 3,899,698 | A | 8/1975 | Kleinschmidt | |
| 4,282,731 | A | 8/1981 | Taksony | |
| 4,490,639 | A | 12/1984 | Echols et al. | |
| 4,854,146 | A | 8/1989 | O'Connell et al. | |
| 4,866,962 | A * | 9/1989 | Aston et al. | 70/277 |
| 4,916,927 | A * | 4/1990 | O'Connell et al. | 70/276 |
| 6,000,609 | A * | 12/1999 | Gokcebay et al. | 235/382 |
| 6,331,812 | B1 * | 12/2001 | Dawalibi | 340/5.2 |
| 6,384,711 | B1 * | 5/2002 | Cregger et al. | 340/5.65 |
| 6,437,684 | B1 * | 8/2002 | Simeray | 340/5.67 |
| 6,474,122 | B2 | 11/2002 | Davis | |
| 6,604,394 | B2 | 8/2003 | Davis | |
| 6,615,625 | B2 | 9/2003 | Davis | |
| 6,629,341 | B2 | 10/2003 | Wilkie et al. | |
| 6,718,806 | B2 | 4/2004 | Davis | |
| 6,895,792 | B2 | 5/2005 | Davis | |
| 6,933,661 | B2 | 8/2005 | Seeley et al. | |
| 6,977,576 | B2 * | 12/2005 | Denison et al. | 340/5.73 |
| 7,640,773 | B2 * | 1/2010 | Bellamy et al. | 70/496 |
| 7,690,231 | B1 * | 4/2010 | Field et al. | 70/283 |
| 8,047,031 | B2 | 11/2011 | Bellamy et al. | |
| 2002/0116968 | A1 * | 8/2002 | Shvarts | 70/370 |

(Continued)

OTHER PUBLICATIONS

Seeley, Charles E.; Delgado, Eladio; Kurtzman, Jan; Bellamy, Dirk, "Miniature Piezo Composite Bimorph Actuator for Elevated Temperature Operation," Proceeding of IMECE 2007 ASME 2007 International Mechanical Engineering Congress & Exposition, Nov. 11-16, 2007, Seattle, Washington, USA, pp. 1 through 11.

(Continued)

*Primary Examiner* — Lloyd Gall
(74) *Attorney, Agent, or Firm* — MH2 Technology Law Group

(57) ABSTRACT

An electronic lock includes a rotatable core movable within an outer body. The rotatable core includes an actuator configured to move a tumbler blocking member into or out of interfering engagement with one or more tumblers. In an unlocked state, the actuator moves the tumbler blocking member so that a movable locking member in the rotatable core that engages the outer body can be moved into the rotatable core. In a locked state, the actuator positions the tumbler blocking member to prevent the one or more tumblers from retracting and thereby retain the locking member in a channel of the outer body.

18 Claims, 8 Drawing Sheets

U.S. PATENT DOCUMENTS

| | | | | |
|---|---|---|---|---|
| 2003/0205070 | A1* | 11/2003 | Chaum | 70/278.3 |
| 2005/0144995 | A1* | 7/2005 | Russell et al. | 70/278.3 |
| 2005/0235714 | A1* | 10/2005 | Lindstrom | 70/493 |
| 2006/0021405 | A1* | 2/2006 | Eden | 70/493 |
| 2007/0074550 | A1* | 4/2007 | Isaacs | 70/279.1 |
| 2007/0266747 | A1* | 11/2007 | Rafferty et al. | 70/134 |
| 2008/0100418 | A1* | 5/2008 | Stobbe et al. | 340/5.73 |
| 2009/0007613 | A1* | 1/2009 | Spycher et al. | 70/278.7 |
| 2009/0013736 | A1* | 1/2009 | Voosen | 70/277 |
| 2009/0165512 | A1 | 7/2009 | Bellamy | |
| 2009/0165513 | A1* | 7/2009 | Bellamy et al. | 70/278.7 |

OTHER PUBLICATIONS

Blaze, Matt, Notes on SFIC (Best) Interchangeable Core Locks, Apr. 21, 2003, http://www.crypto.com/photos/misc/sfic, pp. 1 through 12.

USPTO Non-Final Office Action dated Dec. 10, 2010, U.S. Appl. No. 11/965,107, filed Dec. 27, 2007.

USPTO Non-Final Office Action dated Jun. 14, 2010, U.S. Appl. No. 11/965,107, filed Dec. 27, 2007.

* cited by examiner

LOCK PORTION WITH SOLID-STATE ACTUATOR

BACKGROUND

1. Field of the Invention

The field of the invention relates to electronic locks generally, and more particularly to certain new and useful advances yielding improved actuation and tamper-resistance of an electronic lock, of which the following is a specification, reference being had to the drawings accompanying and forming a part of the same.

2. Discussion of Related Art

Conventional mechanical locks include the basic components of a body, a rotatable cylinder positioned within the body and a series of tumblers. When locked, the tumblers extend from the rotatable cylinder into the body to prevent rotation of the cylinder relative to the body. A specifically shaped key inserted in a keyhole within the cylinder engages the tumblers and moves them such that the cylinder is free to rotate relative to the body, thus unlocking the lock.

Electronic locks provide additional security features, but their relatively small size limits the size and number of internal components that can be housed therein. Although a solenoid is incorporated within a rotatable cylinder of an electronic lock, the solenoid's power source is typically incorporated within a key of the electronic lock. The power source delivers electrical power to the solenoid when the key engages the rotatable cylinder and microprocessor in the rotatable cylinder determines that a code stored in a memory of the key authorizes access.

To resist tampering by sharp blows, some electronic locks incorporate a spring-biased tamper element into the rotatable cylinder. When a sharp blow to the face of the electronic lock moves the solenoid plunger from its locking position, the sharp blow simultaneously moves the spring-based tamper element to interferingly engage the one or more tumblers.

To resist tampering by an external magnetic field, some electronic locks at least partially enclose the solenoid plunger with a ferromagnetic material. When a strong external magnetic field is applied to the electronic lock, the ferromagnetic enclosure causes the solenoid plunger to move out of the ferromagnetic enclosure and block the movement of one or more tumblers, which movement would otherwise unlock the electronic lock.

Notwithstanding the features of electronic locks referenced above, it would be advantageous to develop an electronic lock that has at least one of improved power consumption, improved attack resistance, and improved environmental robustness.

SUMMARY

Described herein are embodiments of an electronic lock having a piezo-electric actuator, a voltage multiplier, and/or a circuit that is coupled with the piezo-electric actuator and configured to resist tampering.

In one aspect, an electronic lock includes an outer body having a bore. The outer body is configured to be mounted to an object. The electronic lock further includes a rotatable core comprising a plug rotatably positioned within the bore and movable relative to the bore in an unlocking direction during a normal unlocking operation. The electronic lock further includes a piezo-electric actuator positioned in the plug and configured to resist movement of a locking member during a non-normal unlocking operation. The locking member is at least partially positioned within a recess of the plug.

Other features and advantages of the disclosure will become apparent by reference to the following description taken in connection with the accompanying drawings.

BRIEF DESCRIPTION OF THE DRAWINGS

Reference is now made briefly to the accompanying drawings, in which.

Like reference characters designate identical or corresponding components and units throughout the several views, which are not to scale unless otherwise indicated.

DETAILED DESCRIPTION

Figure 1:
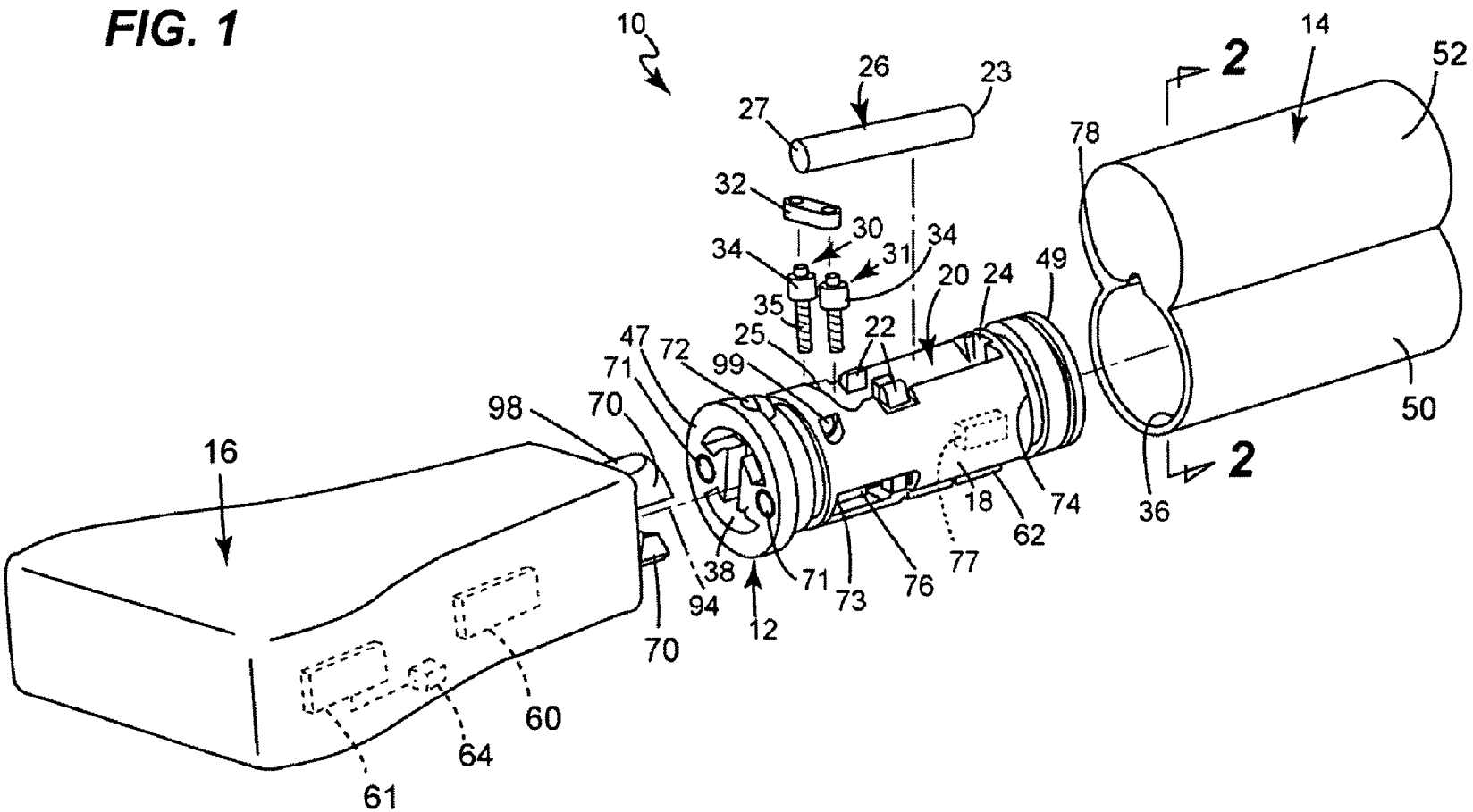
FIG. 1 is an exploded perspective view of an exemplary embodiment of a electronic lock that includes a solid-state actuator configured to move a tumbler blocking member into and out of interfering engagement with one or more tumblers that are coupled with a pivotable locking member.

Embodiments of an electric lock, and associated key, are herein described in detail with reference to the accompanying drawings briefly described above.

Electronic Lock and Key

Referring to FIGS. 1, 2, 3, 4, 5, 6, 7, and 8, an embodiment of an electronic lock 10, includes rotatable core 12, operatively coupled to an outer body 14, and a key 16 configured to engage the rotatable core 12. In one embodiment, as further explained below, the key 16 may be configured to provide 100V or greater to power an electronic lock 10. As with conventional locks, the electronic lock 10 can secure a container or object. For example, the rotatable core 12 can be coupled to a latching mechanism, such as a cam and bolt, that engages a secure portion of a container or object, such as a wall or a door frame. Rotation, or other movement, of the rotatable core 12 disengages the latching mechanism from the secured container or object to gain access to the container or objects.

Referring now to FIGS. 1, 3, 7, and 8, the outer body 14 of the electronic lock 10 includes a bore 36 extending therethrough. The bore 36 has an inner diameter just larger than an outer diameter of the plug 18. In other words, the inner diameter is sized to rotatably receive the plug 18. The bore 36 includes a channel 40 (see FIG. 3) formed in a sidewall of the bore and extending generally parallel to an axis of the bore 36. The channel 40 is positioned intermediate and generally away from the ends of the bore 36.

The channel 40 is sized and shaped to matingly receive the outer body engaging end 27 of the locking member 26, when aligned with the channel 40. In the illustrated embodiments, the channel 40 has a generally semi-circular cross-section with a radius corresponding to a radius of the locking member 26 (best shown in FIGS. 1, 2, 3, 4, 5, 6, and 7). In other embodiments, the locking member 26 can have other elongate shapes, such as, for example, rectangular, triangular and ovular, and the channel 40 can be similarly sized and shaped. Alternatively, the locking member 26 can be a non-elongated element, such as a sphere, with a correspondingly sized and shaped channel. In one embodiment, the locking member 26 is positionable to engage the channel 40 to place the electronic lock in a locked state and is removable from the channel 40 to place the lock in an unlocked state.

Figure 3:
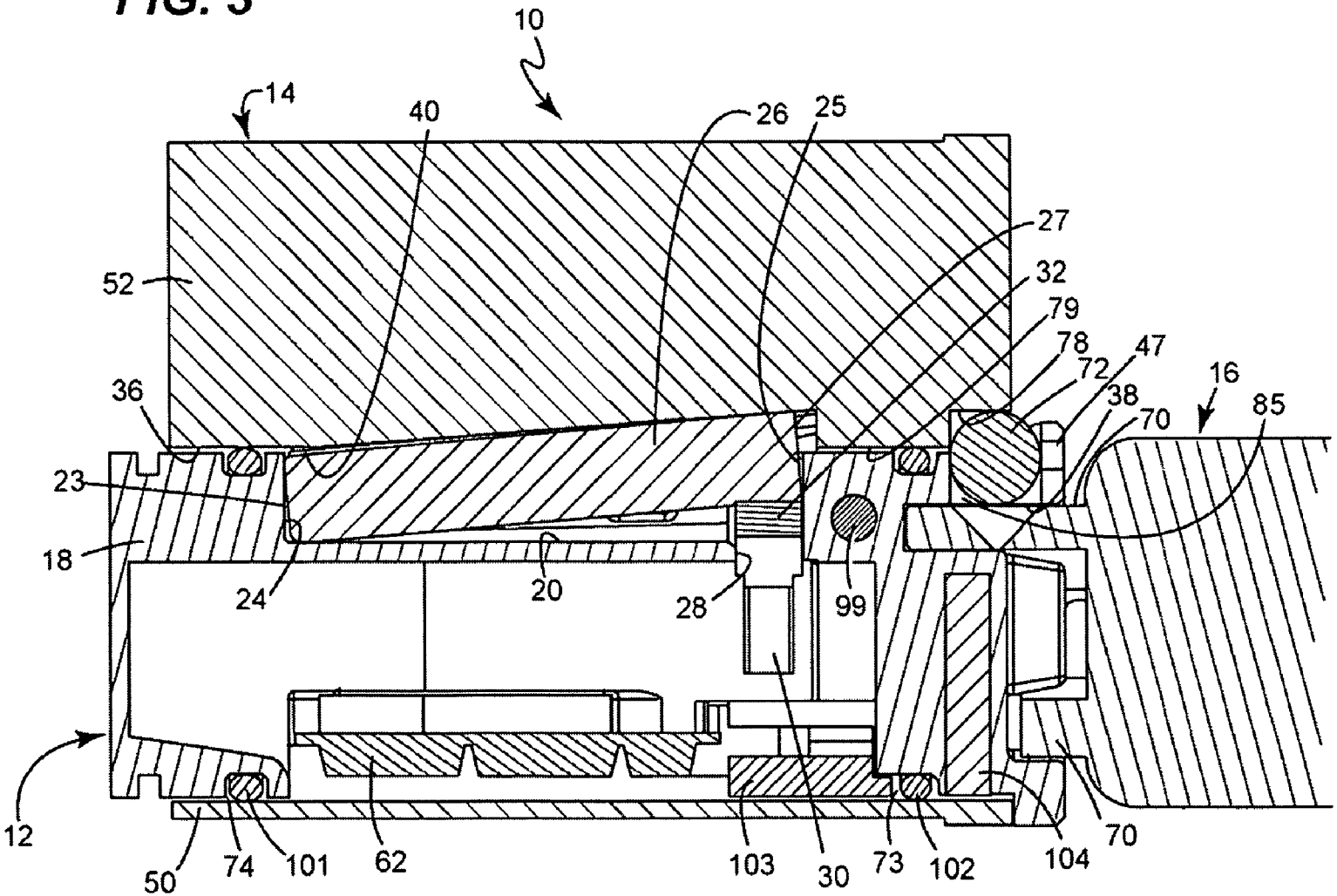
FIG. 3 is a cross-sectional side view of the electronic lock of FIG. 2 taken along the line 3-3 in FIG. 2.
Figure 4:
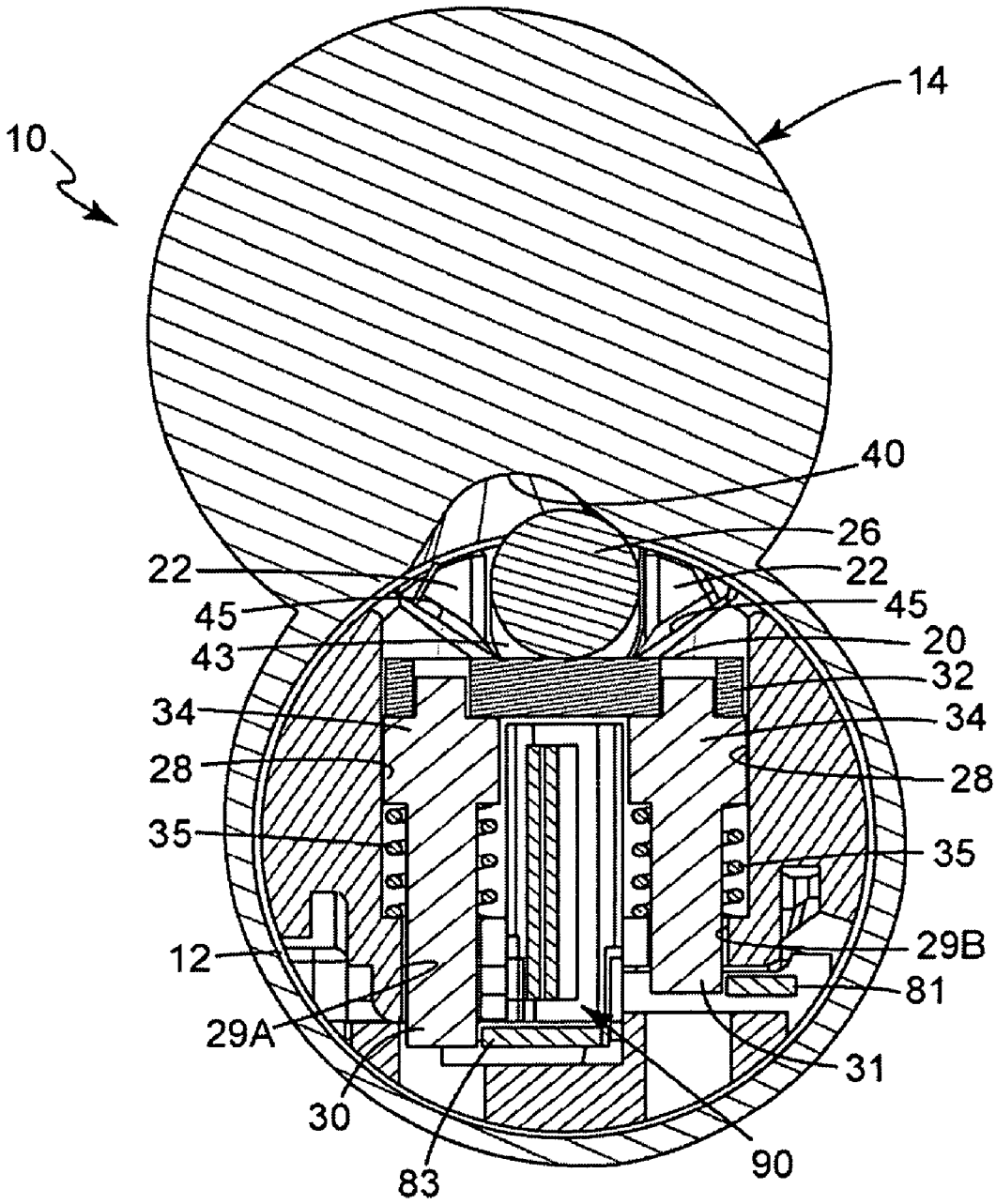
FIG. 4 is a cross-sectional view of the electronic lock of FIG. 1 taken along the line 2-2 in FIG. 1, the electronic lock being shown in a partially unlocked state.
Figure 5:
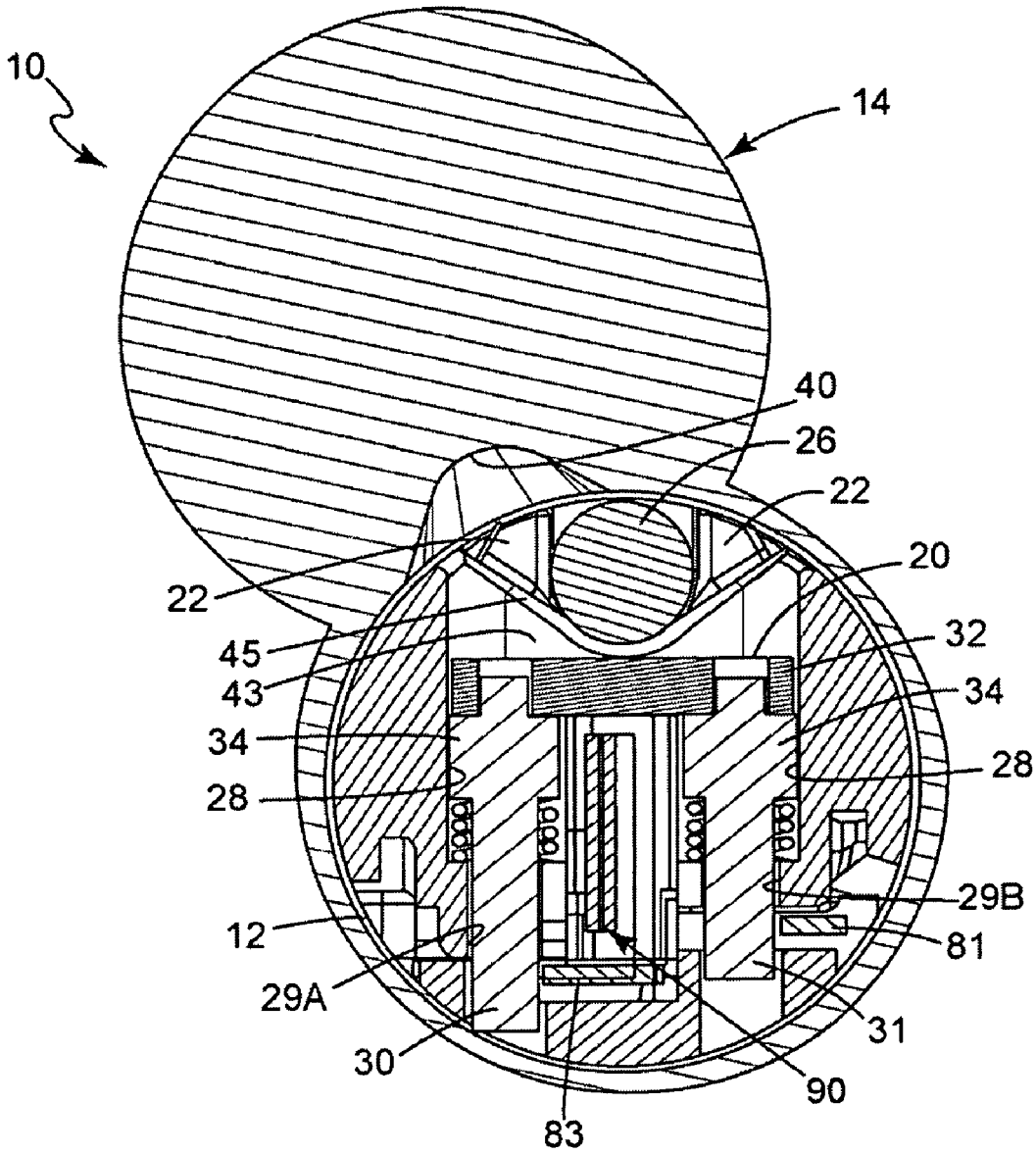
FIG. 5 is a cross-sectional view of the electronic lock of FIG. 1 taken along the line 2-2 in FIG. 1, the electronic lock being shown in an unlocked state.

As best shown in FIG. 3, the bore 36 further includes a second channel 78, which is separated from the channel 40 by member 79, which extends into the interior of the bore 36. The second channel 78 has a generally semi-circular cross section with a radius corresponding to a radius of a sphere 72. The sphere 72, which may be made of a hardened metal or a hardened metal alloy, resides within an opening 85 formed in the plug 18. As the plug 18 is rotated, the sphere 72 may move within the opening 85 toward and/or away from the longitudinal axis 94 of the electronic lock 10 to engage and/or disengage the receiving opening (98) in one of the flanges 70. An axis of the opening 85 is orthogonal to the longitudinal axis 94 of the electronic lock 10.

Advantageously, the outer body 14 can have the same outer configuration as a conventional mechanical lock, so the electronic lock 10 can be used to retrofit many unique types of conventional mechanical locks. For example, the outer body 14 can include a first portion 50 having a generally cylindrical outer shape adjoined to a second securing portion 52 also having a generally cylindrical outer shape. In other implementations, the outer body 14 can have a generally rectangular, circular, triangular, or other desirable shape.

The rotatable core 12 includes a plug 18 having a generally cylindrical shape. To improve environmental robustness, the plug 18 may have one or more o-ring channels 73, 74 (best shown in FIGS. 1 and 3) circumscribed about its circumference. In an embodiment, a first o-ring channel 73 is formed in the plug 18 proximate a key receiving end 47 of the plug 18. The second o-ring channel 74 is formed in the plug 18 proximate a rear end 49 of the plug 18. As shown in FIG. 3, the first o-ring channel 73 is configured to receive a first o-ring 102; and the second o-ring channel 74 is configured to receive a second o-ring 101. Both the first o-ring 102 and the second o-ring 101 may be formed of any suitable sealing material that permits the plug 18 to rotate within the bore 36 when the electronic lock 10 is unlocked. As further shown in FIG. 7, the o-rings 101 and 102 each protrude above an exterior surface of the plug 18 so that when the plug 18 is rotatably inserted within the bore 36, the circumference of each o-ring 101, 102 sealably and rotatably engages an inner surface of the bore 36.

As shown in FIGS. 1, 2, 3, 4, 5, and 7, the plug 18 includes an elongate locking member receiving recess 20 (hereinafter, "recess 20"). The recess 20 can have a generally v-shaped cross-section with a curved vertex 43 and a ledge 45 extending away from the vertex (best shown in FIGS. 2, 4, and 5). The recess 20 can extend generally parallel with a longitudinal axis 94 (best shown in FIG. 1) of the plug 18 and can be formed in an outer surface of the plug 18 intermediate a key receiving, end 47 and a rear end 49 of the plug 18. Spaced apart deformable members 22 (best shown in FIGS. 1 and 7) can be attached to or formed as one piece with the rotatable rotatable core 12 or the outer body 14.

For example, as shown in FIG. 1, deformable members, such as projections 22, can be integral with the recess 20 of the rotatable core 12 and positioned intermediate a locking member pivoting end 24 and a tumbler receiving end 25 of the recess 20. The projections 22 are spaced apart a distance slightly greater than a width of the locking member 26, and facilitate at least partial vertical alignment of the locking member 26 as the locking member 26 moves through its nominal range of motion, as will be further described below.

The locking member 26 has a generally elongate cylindrical shape with a pivoting end 23 and an outer body engaging end 27. In one embodiment, the locking member 26 is a standard hardened dowel pin.

The pivoting end 24 of the recess 20 can be slightly cupped and configured to receive the rounded pivoting end 23 of the locking member 26 and to facilitate movement of the locking member 26 relative to the recess 20, such as a vertically-oriented rotation of the locking member 26 about its pivoting end 24 when coupled to the recess 20. The tumbler receiving end 25 of the recess 20 can include an opening 28 (best shown in FIGS. 2, 4, 5) and adjoining openings 29A and 29B (best shown in FIGS. 2, 4, 5) extending perpendicular to the longitudinal axis 94 (FIG. 1) of the plug 18, with each opening 29A and 29B having a smaller cross-section than the opening 28. The opening 28 is sized to receive two tumbler pins 30, 31 (best shown in FIGS. 1, 2, 3, 4, 5, 6, and 8) and a support element 32 (best shown in FIGS. 1, 2, 3, 4, 5, and 6). The opening 29A is configured to receive and align a first tumbler pin 30; and the opening 29B is configured to receive and align the second tumbler pin 31, which has a length shorter than a length of the first tumbler pin 30. The support element 32, positioned between the tumblers 30, 31 and the body engaging end 27 of the locking member 26 includes spaced apart openings through which each tumbler 30, 31 extends up to a stop 34 formed in, or coupled with, the tumblers 30, 31. The first tumbler 30 and the second tumbler 31 are each coupled with the locking member 26 by the support member 32.

As FIGS. 1, 2, 4, 5 and 6 best illustrate, resilient members 35, such as springs encompass the tumblers 30, 31. The tumbler blocking member 80 (best shown in FIG. 6) interferingly engages the ends of the tumblers 30, 31 to prevent movement of the tumblers 30, 31 away from a channel 40 (best shown in FIGS. 1, 2, 3, 4, and 5) formed in the outer body 14 that engages the locking member 26. With the tumblers 30, 31 being prevented from downward movement, by the tumbler blocking member 80, engagement between the locking member 26 and the channel 40 is maintained even though an attempt is made to turn the rotatable core 12.

The plug 18 includes a keyhole 38 (best shown in FIGS. 1, 3 7, and 8) extending from the key receiving end 47 of the plug 18 and sized to receive the key 16 (FIG. 1). The key 16 can be an access device with one or more electrical components 60, 61, 64 (best shown in FIG. 1) that communicate with and/or transfer power to one or more operating components of the removable core 12. Non-limiting examples of the one or more operating components of the removable core 12 include a micro-processor based circuit 62 (best shown in FIGS. 1, 3, and 8), a solid-state actuator 90 (best shown in FIG. 6), and a voltage multiplier circuit 77 (best shown in FIG. 1).

Referring again to FIG. 1, the key 16 includes a memory 60 that contains user identification information or access code information readable by the micro-processor based circuit 62, which is located in the plug 18. The microprocessor-based circuit 62 can be coupled with a voltage multiplying circuit 77 and/or with the solid-state actuator 90 (FIG. 6), each of which can be selectably controllable by the microprocessor based circuit 62 to unlock the electronic lock 10. The components and operation of the voltage multiplying circuit 77 and the solid-state actuator 90 are further described below. As used herein, the phrase "unlock the electronic lock 10" means to move or release the tumbler blocking member 80 (FIG. 6) out of interfering engagement with the tumblers 30, 31 (FIGS. 1, 2, 4, 5, 6, and 8), when the user identification information or access code(s) read by the micro-processor based circuit 62 (FIGS. 1, 3, and 8) determines that access is authorized. The key 16 further includes one or more flanges 70. At least flange 70 is configured to engage the keyhole 38 of the electronic lock 10. At least another flange 70, which is electrically coupled with the power supply 61, or is alternatively electrically coupled with the second voltage multiplier circuit 64, is configured to electrically couple with one or more contact pins 71 to provide a voltage of at least 100V to the voltage multiplier circuit 77, which is electrically coupled with the one or more contact pins 71.

Referring briefly to FIG. 1, in some implementations, power transfer and data transfer between the memory 60 and the micro-processor based circuit 62 is initiated by inserting the flanges 70 of the key 16 into the keyhole 38 and/or the contact pins 71 to establish electrical contact between the power supply 61 and the voltage multiplier circuit 77 and to establish electrical contact between the memory 60 and the micro-processor based circuit 62. In other implementations, the memory 60 can communicate wirelessly with the micro-processor based circuit 62, such as, for example, via an infrared or RF communications link, to transmit data between the memory 60 and the micro-processor based circuit 62.

Solid-State Actuator

Figure 6:
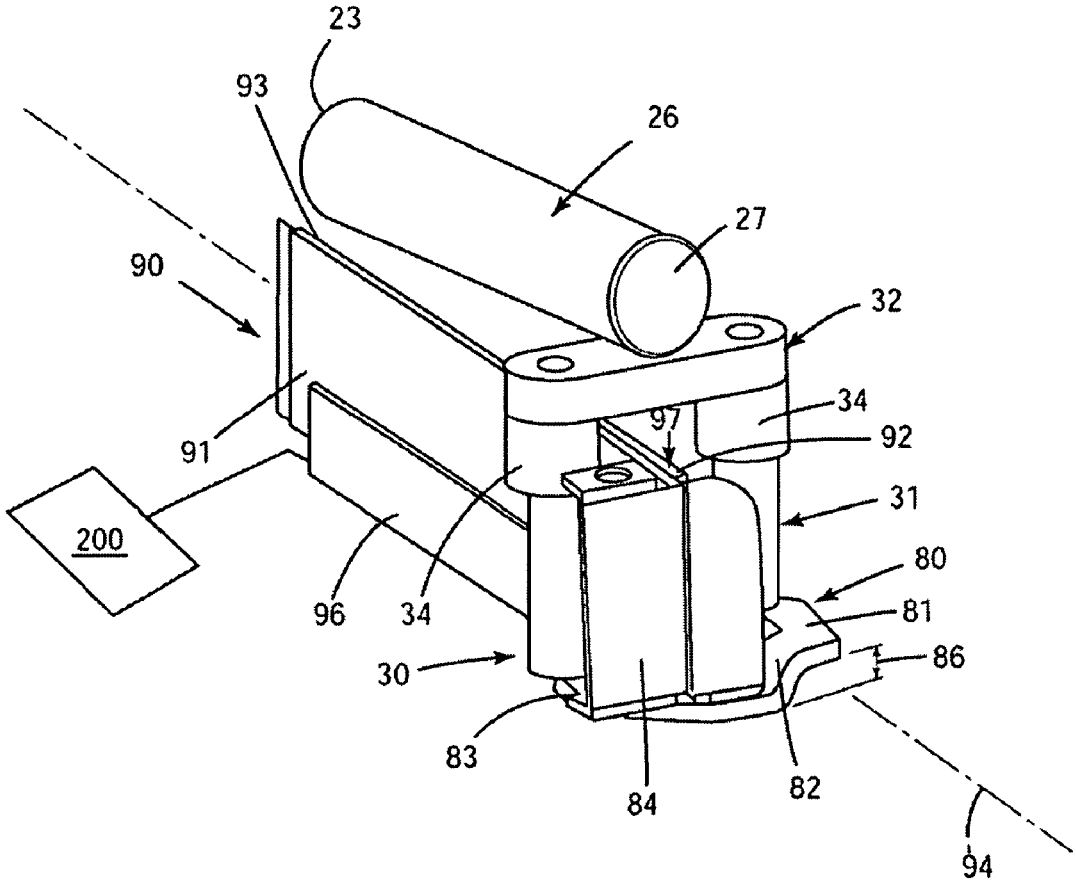
FIG. 6 is a perspective view of an exemplary embodiment of a solid-state actuator coupled via tumbler blocking member with one or more tumblers and a locking member.
Figure 7:
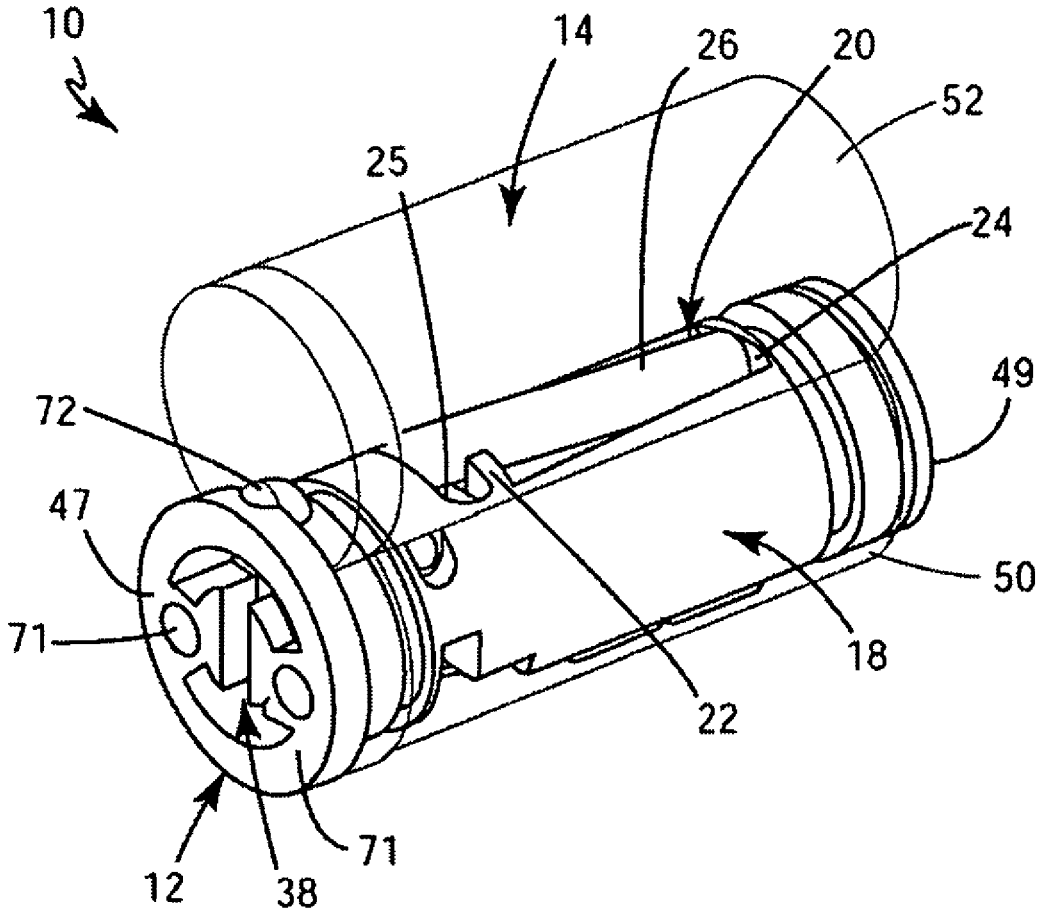
FIG. 7 is a perspective view of an embodiment of the electronic lock of FIG. 1 showing a rotatable core inserted within a bore of a outer body.
Figure 8:
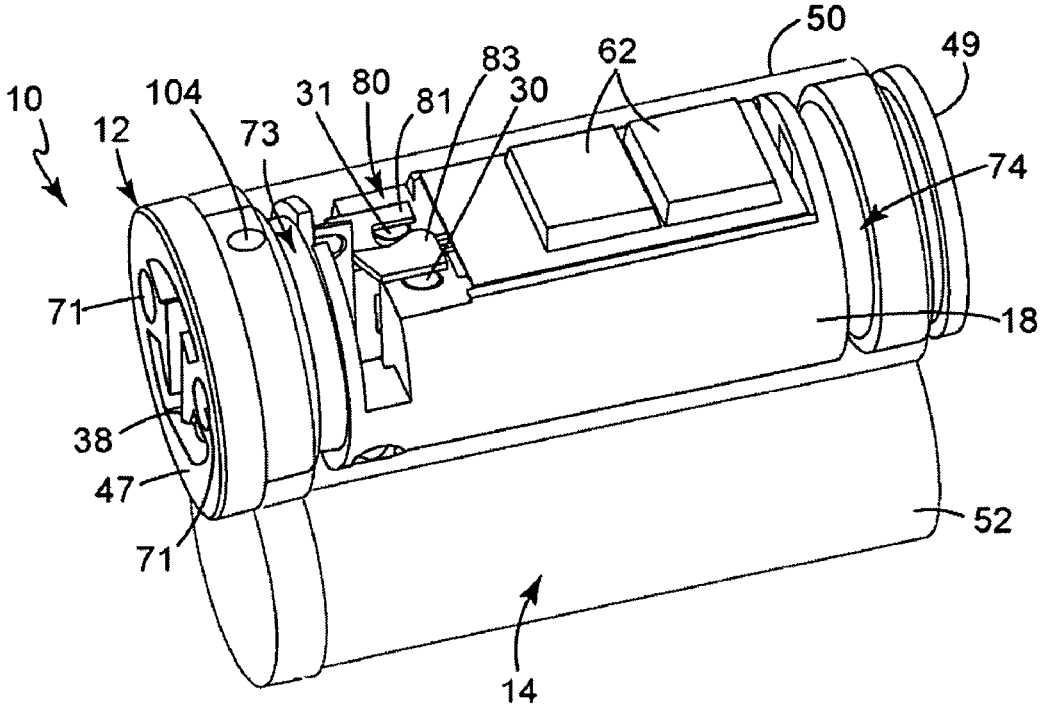
FIG. 8 is another perspective view of the embodiment of the electronic lock of FIG. 7, with some structure removed to further illustrate the tumbler blocking member of FIG. 6.

Referring primarily to FIG. 6, but also to FIGS. (2, 4, 5, and 8) embodiment of the electronic lock 10 includes a solid-state actuator 90, which is configured to resist movement of the locking member 26 during a non-normal unlocking operation. A connector 96, such as a flex circuit, of the solid-state actuator 90 may be electrically coupled with the voltage multiplier circuit 77 (FIG. 1). The connector 96 is electrically coupled with either member 91 or member 92 of the solid-state actuator 90. An end 97 of the solid-state actuator 90 may be disposed between the tumblers 30, 31, as illustratively shown in FIG. 6. In one embodiment, a resistance of the solid-state actuator 90 may be about 1 M Ohm or greater.

In one embodiment, the solid-state actuator 90 is a piezo-electric actuator. However, other types of solid-state actuators may also be used, and embodiments of the invention are not limited merely to piezo-electric actuators.

The piezo-electric actuator 90 included in an embodiment of the electronic lock 10 is a special-purpose, miniature, piezo-electric actuator, which is configured to function in small spaces without additional resources, such as pumps. As used herein, the terms "special-purpose, miniature, piezo-electric actuator" and "piezo-electric actuator" each refer to a piezo composite bimorph actuator, or another type of piezo-electric actuator having like properties. Illustratively, these properties may include, but are not limited to: a size of about 25 mm×5 mm, ability to generate a large stroke relative to its size of about 1 mm, stability over a relatively large temperature range of about −30° C. to about 150° C. with a variation of less than about 0.1 mm in the actuator position, ability to engage within about 10 ms or faster, and operative when electrical energy in a range of about 1,000 Volts to about 2,500 Volts is applied. For purposes of illustration, a non-limiting example of a piezo composite bimorph actuator is a macro fiber composite ("MFC") based bimorph actuator developed by the General Electric Global Research Center in Niskayuna, N.Y. In one embodiment, the piezo-electric actuator 90 is configured not to move to an unlocked state when subjected to an extreme temperature beyond its operating limits.

In an embodiment, the piezo-electric actuator 90 includes a first member 91 coupled with a second member 92. A substrate 93, which is formed of a ferrous material or a non-ferrous material, is disposed between the first member 91 and the second member 92. Each of the first member 91 and the second member 92 is an active layer comprised of a piezo-electric material, which is operational up to about 150° C., or about one half of Curie temperature.

The piezo-electric material can be comprised of known man made or industrial materials. For example, PZT (lead zirconate titinate), or a variation thereof, such as PZT 5A (available from Morgan Electro Ceramics, Bedford, Ohio), may be used. As another example, either a monolithic ceramic or a macro fiber composite (MFC) can be used. The MFCs have the added advantage that they result in much larger forces, and therefore greater movement is exhibited by the piezo-electric actuator 90. An MFC may be comprised of a sheet of aligned rectangular piezoceramic fibers, layered on each side with structural epoxy, which is then covered by polyimide film. The sheets of aligned rectangular piezoceramic fibers provide the added advantage of improved damage tolerance and flexibility relative to monolithic ceramics. The structural epoxy inhibits crack propagation in the ceramic and bonds the actuator components together. The polyimide film, which is the top and bottom layers of the actuator, may be comprised of an interdigitated electrode pattern on the film, and permit in-plane poling and actuation of the piezoceramic.

In one embodiment, the first member 91 is an active layer of a piezo-electric material that is polarized along a plane of the material, parallel to the substrate 93. Additionally, the second member 92 is an active layer of a piezo-electric material that is polarized through a thickness of the second member 92, perpendicular to the substrate 93.

In operation, both the first member 91 and the second member 92 are subjected to positive electric fields, which can be generated by the voltage multiplier circuit 77 (FIG. 1). Although both the first member 91 and the second member 92 are subjected to a positive electric field in the direction of polarization, the piezo-electric actuator 90 bends due to piezoelectric coefficients which are opposite in signs. Depending on the desired results the electric fields that are applied to the top and bottom active materials vary, and they may be the same or different strength electric fields.

In the embodiment wherein the first member 91 and the second member 92 are piezoelectric materials, the top piezo-electric material is polarized along the plane of the piezoelectric wafer such that the d33 piezoelectric coefficient is exploited (d33=374 pm/V for PZT 5A). The bottom piezo-electric material is polarized through the thickness such that the d31 piezoelectric coefficient is exploited (d31=−171 pm/V). Again, even though there is a positive electric field on both sides of the actuator, the actuator bends because the d33 and d31 coefficients are opposite in sign. Thus, the top expands and the bottom contracts from the piezo coefficient orientation, rather than the sign of the electric field.

As both active materials are subjected to positive electric fields, they do not exhibit the same problems as exhibited when an active material, particularly a piezoelectric material, is subjected to a negative electric field and an elevated temperature. In those cases, depolarization is seen at temperatures as low as about 50° C. In the present embodiments, there are no electric fields applied against the direction of polarization, therefore the active materials, such as piezoelectric materials, will retain their polarization at levels of at least about 50% of Curie temperature. For one common piezoelectric material PZT 5A, the piezoelectric properties are retained up to at least about 150° C., one half of Curie temperature.

Voltage Multiplier Circuit

Referring to FIGS. 1, 3, 6, 7, and 8, additional embodiment of the invention addresses the issue of providing power to the piezo-electric actuator 90. Due to certain desired characteristics, such as limited space, a small power supply 61 (FIG. 1) is included in the key 16 (FIG. 1) to operate the piezo-electric actuator 90 (FIG. 6). In one embodiment, the power supply 61 may be a battery capable of delivering 3 Volts to a voltage multiplier circuit 77, which is configured to boost the voltage significantly. For example, when MFC is used as the active material for the first member 91 and/or the second member 92 of the piezo-electric actuator 90, about 1,500 volts is required to cause the piezo-electric actuator 90 to move.

In another embodiment, the power supply 61 in the key 16 is configured to deliver about 300 Volts to the voltage multiplier circuit 77. For the key 16 to deliver 100 V plus to the contact pins 71 of the rotatable core 12, the power supply 61 may be a 3V battery coupled with a second voltage multiplier circuit 64 located in the key 16. The second voltage multiplier circuit 64 can be configured to have a predetermined multiplier factor, which will boost the initial power supply voltage to 100V plus, i.e., 300 V in one embodiment.

The voltage multiplier circuit 77 located in the plug 18, can also be configured to have a predetermined multiplier factor. For example, in one embodiment, the voltage multiplier circuit 77 has a 5:1 multiplier factor, which means that for every 1 Volt received from the power supply 61, the voltage multiplier circuit 77 can deliver 5 Volts to the piezo-electric actuator 90. Description of the 5:1 multiplier is merely exemplary, it being understood that other multiplier factors may be used in either voltage multiplier circuit 77, 64 in other embodiments of the invention.

In any event, the voltage multiplier circuit 77 is configured to multiply electrical power supplied by the power supply 61 when one or more flanges 70 (FIGS. 1 and 3) of the key 16 are inserted into the keyhole 38 and/or into one or more openings 71 (FIGS. 1, 7, and 8), which are formed in the key receiving end 47 of the plug 18. Consequently, the piezo-electric actuator 90 can receive electrical power from the voltage multiplier circuit 77 in a range of about 1,000 Volts to about 2,500 Volts, once the key 16 engages the electronic lock 10.

In one embodiment, the voltage multiplier circuit 77 may have a series connected high voltage tandem flyback ("HVTF") design, in which two flyback transformers have input windings connected in parallel and outputs connected in series. Of course, other voltage multiplier circuit designs are possible and contemplated. Implementation of the HVTF circuit topology permits use of a low power high voltage power supply 61 in the key 16. The second voltage multiplier circuit 64 can be similarly configured.

Tumbler Blocking Member

In an embodiment, a stem 84 of a tumbler blocking member 80 (FIGS. 6 and 8) is coupled with the substrate 93 of the piezo-electric actuator 90 (FIG. 6), or formed as an integral part of the substrate 93.

On one side of the stem 84, the tumbler blocking member includes a first flange 83 that is configured to interferingly engage an end of tumbler 30 when the piezo-electric actuator 90 occupies a first position, as shown in FIG. 6. On an opposite side of the stem 84, the tumbler blocking member 80 includes a riser 82 coupled with a second flange 81. The second flange 81 is configured to interferingly engage an end of the tumbler 31 when the piezo-electric actuator 90 occupies the first position. Since the tumbler 31 is shorter than the tumbler 30, the riser 82 couples the second flange 81 with the stem 84. As shown in FIG. 6, the first flange 83 and the second flange 81 are separated by a predetermined distance 86. In one embodiment, the predetermined distance 86 is measured perpendicular to the longitudinal axis 94 of the electronic lock 10, and will vary depending on the respective lengths of the tumblers 30, 31. The components of the tumbler blocking member 80 may be formed of metal, a metal alloy, plastic, combinations thereof, and the like.

Tamper Resistance

To improve tamper resistance, an embodiment of an electronic lock 10 having a piezo-electric actuator (90) is configured to resist an externally induced acceleration of the electronic lock 10, or of one or more of its components, such as the piezo-electric actuator (90), the tumblers 30,31, the locking member (26), and so forth, by shunting electrical power produced by an externally induced motion of the piezo-electric actuator 90 back to the piezo-electric actuator 90.

For example, an embodiment of the electronic lock 10 includes tamper circuitry 200 (best shown in FIG. 6) coupled with a connector 96 of the piezo-electric actuator 90. The tamper circuitry 200 is configured to collect a voltage created when the piezo-electric actuator 90 moves in response to an externally induced acceleration generated by one or more sharp blows applied to the electronic lock 10. The tamper circuitry 200 is further configured to shunt the collected voltage back into the piezo-electric actuator 90 to resist further movement of the piezo-electric actuator 90 that could cause the electronic lock 10 to unlock. In one embodiment, the tamper circuitry 200 is one of a resistor circuit and a resistor-inductor circuit.

In one embodiment, the plug 18 is configured to improve a resistance of the electronic lock 10 to an aggressive over-torque attack. In this regard, the unitary plug 18 has advantages over prior electronic locks having a multi-piece plug. In an over-torque attack an attempt is made to twist the end 47 of the removable core 12 with a torque sufficient to break the plug 18. In an embodiment, a unitary plug 18 is formed from a single piece of material, which may be a metal, a metal alloy, or combinations thereof.

The electronic lock 10 can be configured to improve resistance to a magnet attack. In a magnet attack, a magnet having a strong external field is held proximate the electronic lock 10 to urge one or more components of the plug 18 to move into unlocked positions. Thus, in one embodiment, to strengthen the electronic lock's resistance to magnet attack, at least one of the substrate 93, the stem 84, the flanges 81, 82, and/or the tumbler blocking member 80 each comprise one or more non-magnetic materials. Alternately, at least one of the substrate 93, the stem 84, the flanges 81, 82 comprise magnetic materials and are configured to become biased into locked positions when influenced by an external magnetic field.

To improve resistance to drilling, hardened drill pins 99, 103, 104 (FIGS. 1, 3, and 8) can be embedded in the plug 18. Additionally, the plug 18 can be formed of a single piece of a hardened material.

Operation of the Electronic Lock

Figure 2:
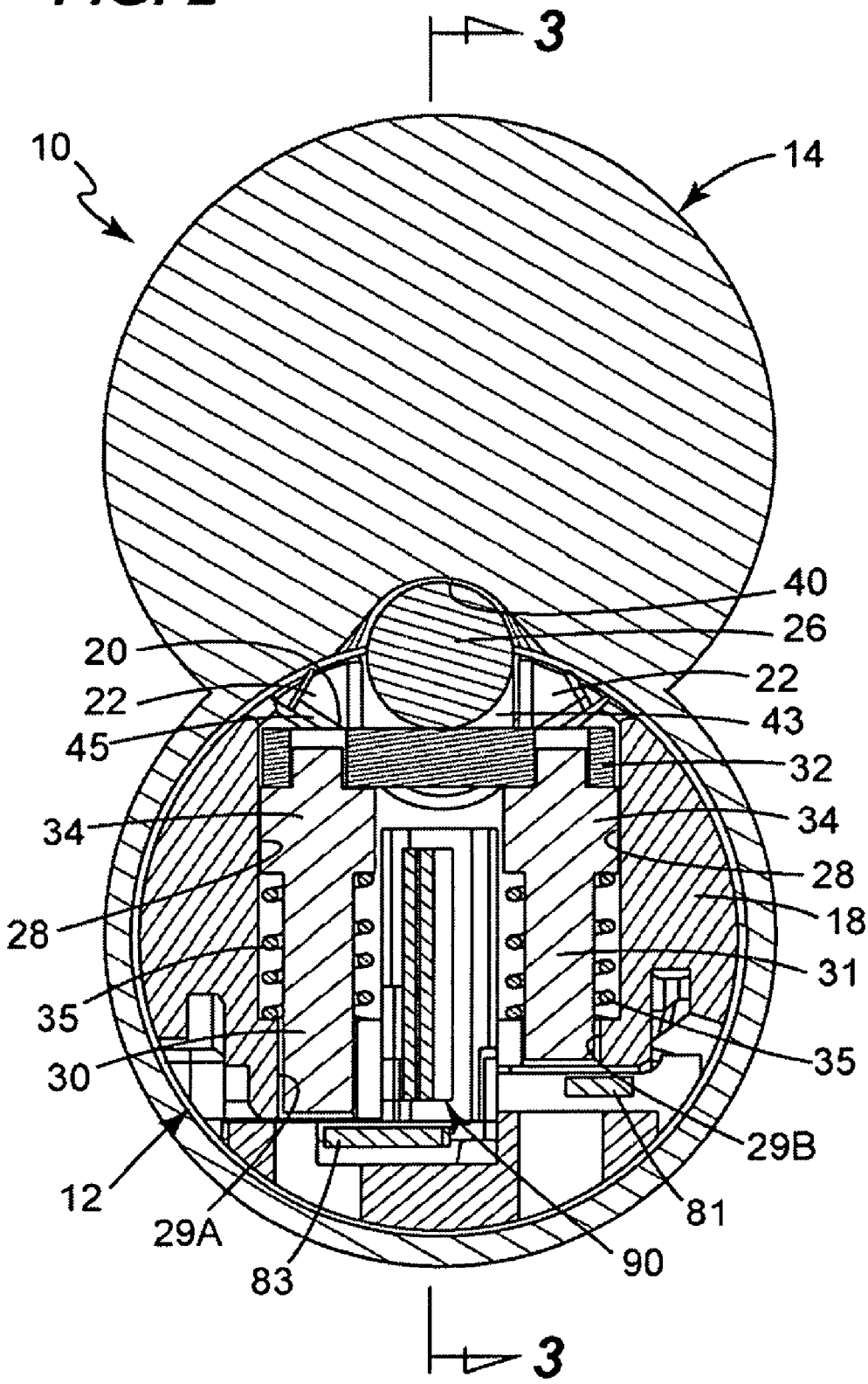
FIG. 2 is a cross-sectional view of the electronic lock of FIG. 1 taken along the line 2-2 in FIG. 1, the electronic lock being shown in a locked state.

Referring to FIGS. 1, 4, 5, and 6, a individual may seek unauthorized access to the electronic lock 10 when the piezo-electric actuator 90 and the tumbler blocking member 80 occupy the first position(s) illustrated in FIGS. 2 and 6, i.e., when the electronic lock 10 is in a locked state. This may occur by inserting an incorrect key into the keyhole 38 and applying a torsional force less than a predetermined maximum torsional force to the rotatable core 12. Under such circumstances, the locking member 26, being prevented from moving downwardly away from the channel 40 by the flanges 81, 82 of the tumbler blocking member 80, at least partially engages the channel 40 and a deformable projection 22 to prevent rotation of the plug 18 relative to the outer body 14.

If the applied torsional force meets or exceeds the predetermined maximum torsional force, such as by aggressive tampering of the electronic lock 10, the deformable projections 22 are configured to deform or collapse from the pressure being applied to them by the locking member 26. In other embodiments, resilient members (not shown) can be substituted for the deformable members 22 and configured to substantially resist deformation up to the predetermined maximum torsional force, but allow deformation, e.g., by flexing, upon reaching or exceeding the predetermined maximum torsional force.

On the other hand, a user seeking authorized access can insert an authorized key 16 into the keyhole 38 to perform a normal unlocking operation. As mentioned above, the electronic lock 10 may include a key 16 having a low power, high voltage power supply 61. The key 16 is engageable with the rotatable core 12 to actuate the piezo-electric actuator 90 to disengage the tumbler blocking member 80 and allow movement of the rotatable core 12 relative to the outer body 14.

For example, upon insertion of an authorized key 16, voltage is supplied from the low power, high voltage power supply 61 to the voltage multiplier circuit 77. The voltage multiplier circuit 77 increases the voltage supplied by the power supply 61 by a predetermined multiple and applies the multiplied voltage to the piezo-electric actuator 90 (FIGS. 4, 5, 6), to urge tumbler blocking member 80 to move a predetermined distance. Movement of the first member 91 shifts the tumbler blocking member 80 so that first flange 83 moves out of blocking position with the tumbler at the same time that second flange 81 moves out of blocking position with the tumbler 31 to place the electronic lock 10 in an unlocked state (see FIG. 5).

With the tumblers 30, 31 unrestrained from movement by the flanges 83, 81, respectively of the tumbler blocking member 80, the user's rotation of the key 16 causes the plug 18 to rotate and the locking pin 26 to move into the plug 18 as a result of its interaction with the channel 40. Further rotation of the plug 18 urges the locking pin 26 to slide out of the channel 40 and slide along the inner surface of the bore 36 (FIG. 3). The user is then allowed to unobstructively rotate the rotatable core 12 relative to the outer body 14 to disengage a latch or other securing element coupled to the rotatable core 12 and thereby access a secured area.

Alternatives

Although the recess 20 and deformable projections 22 are formed in the rotatable plug 18 and the locking member receiving channel 40 is formed in the outer body 14 in the illustrated embodiments, it is recognized that in some implementations, the recess 20 and deformable projections 22 can be formed in the outer body 14 and the locking member receiving channel 40 can be formed in the plug 18. Further, other components inserted into or housed within the rotatable rotatable core 12 can be inserted into or housed within the lock outer body 14.

Unless otherwise noted, the various components of the electronic lock 10 described herein can be made from a strong, rigid material such as steel. Of course, in some applications, other materials can be used, such as, but not limited to, other metals, including aluminum, brass, stainless steel, zinc, nickel and titanium.

Referring briefly to FIG. 6, in an alternate embodiment, the first member 91 and the second member 92 are not separated by a passive material, such as the substrate 93, but are connected directly. In such an embodiment, the connection may include the presence of an adhesive, such as an epoxy, between the first member 91 and the second member 92.

As used herein, an element or function recited in the singular and proceeded with the word "a" or "an" should be understood as not excluding plural said elements or functions, unless such exclusion is explicitly recited. Furthermore, references to "one embodiment" of the claimed invention should not be interpreted as excluding the existence of additional embodiments that also incorporate the recited features.

Although specific features of various embodiments of the invention may be shown in some drawings and not in others, this is for convenience only. In accordance with the principles of the invention, the feature(s) of one drawing may be combined with any or all of the features in any of the other drawings. The words "including", "comprising", "having", and "with" as used herein are to be interpreted broadly and comprehensively and are not limited to any physical interconnection. Moreover, any embodiments disclosed herein are not to be interpreted as the only possible embodiments. Rather, modifications and other embodiments are intended to be included within the scope of the appended claims.

What is claimed is:

1. An electronic lock, comprising:

an outer body having a bore and configured to be mounted to an object;

a rotatable core comprising a plug rotatably positioned within the bore and movable relative to the bore in an unlocking direction during a normal unlocking operation; and a solid-state actuator positioned in the plug and configured to resist movement of a locking member during a non-normal unlocking operation, said solid-state actuator having a first position and a second position, wherein the solid-state actuator is in the first position when the electronic lock is locked and in the second position when the electronic lock is unlocked, wherein the solid-state actuator generates electrical power in response to the non-normal unlocking operation and the generated electrical power is shunted back to the solid-state actuator such that the solid-state actuator is biased toward the first position.

2. The electronic lock of claim 1, wherein the bore comprises a channel, and wherein at least a portion of the locking member is positionable to engage the channel to place the electronic lock in a locked state and removable from the channel to place the electronic lock in an unlocked state.

3. The electronic lock of claim 1, wherein the solid-state actuator is a piezo-electric actuator.

4. The electronic lock of claim 3, wherein the piezo-electric actuator is a special-purpose piezo composite actuator.

5. The electronic lock of claim 3, further comprising:

a voltage multiplier circuit coupled with the piezo-electric actuator.

6. The electronic lock of claim 5, wherein the voltage multiplier circuit is configured to multiply, by a predetermined multiple, electrical power supplied by a power source in a key associated with the electronic lock when the key is engaged with the electronic lock.

7. The electronic lock of claim 1, further comprising:

a first tumbler positioned within the plug; and a second tumbler positioned within the plug, wherein the second tumbler has a length shorter than a length of the first tumbler, and wherein the first tumbler and the second tumbler engage a support member that engages the locking member.

8. The electronic lock of claim 3, further comprising:

a tumbler blocking member coupled with the piezo-electric actuator.

9. The electronic lock of claim 8, wherein the tumbler blocking member comprises:

a stem;

a first flange coupled on one side of the stem; and a riser coupled on the other side of the stem to a second flange.

10. The electronic lock of claim 8, further comprising:

a key having a power supply, wherein the key is engageable with the rotatable core to actuate the piezo-electric actuator to disengage the tumbler blocking member and allow movement of the rotatable core relative to the outer body.

11. The electronic lock of claim 10, wherein the key further comprises:

a second voltage multiplying circuit configured to supply 100V or greater to one or more contact pins formed in the plug to power the piezo-electric actuator.

12. The electronic lock of claim 1, further comprising:

one or more hardened anti-drill pins.

13. The electronic lock of claim 9, wherein at least one of a substrate of the piezo-electric actuator, the stem, and the flanges each comprise one or more non-magnetic materials.

14. The electronic lock of claim 9, wherein at least one of a substrate of the piezo-electric actuator, the stem, and the flanges comprise magnetic materials and are configured to become biased into locked positions when influenced by an external magnetic field.

15. The electronic lock of claim 3, wherein the piezo-electric actuator has a resistance of greater than 1 M ohm.

16. The electronic lock of claim 1, wherein the plug is formed of a single piece of material.

17. A lock comprising:

a locking member;

a special-purpose piezo ceramic actuator preventing movement of the locking member when the special-purpose piezo ceramic actuator is not receiving a voltage from a power source;

a voltage multiplier circuit coupled with the special-purpose piezo ceramic actuator, wherein the voltage multiplier circuit is configured to boost a voltage received from a key associated with the lock and to apply the boosted voltage to the special-purpose piezo ceramic actuator such that the special-purpose piezo ceramic actuator enables movement of the locking member, wherein the voltage multiplier circuit is a high voltage tandem flyback circuit boosting the voltage from the power supply to at least 1000 volts; and a tamper circuit, coupled with the special-purpose piezo ceramic actuator, that shunts electrical power produced by an externally induced motion of the special-purpose piezo ceramic actuator to the special-purpose piezo ceramic actuator.

18. A system comprising:

a key comprising:

a power supply;

a first voltage multiplier circuit coupled with the power supply and configured to boost a voltage from the power supply to a first boosted voltage of at least 100 volts; and a flange electrically coupled with the first voltage multiplier circuit and configured to electrically couple with a contact pin and provide the first boosted voltage from the first voltage multiplier circuit to the contact pin; and an electronic lock comprising:

the contact pin configured to electrically couple with the flange of the key and receive the first boosted voltage from the key;

a locking member;

a solid-state actuator preventing movement of the locking member when the solid-state actuator is not receiving the first boosted voltage from the contact pin; and a second voltage multiplier circuit coupled with the solid-state actuator, wherein the second voltage multiplier circuit is configured to boost the first boosted voltage received from the flange of the key to a second boosted voltage and to apply said second boosted voltage to the solid-state actuator such that the solid-state actuator enables movement of the locking member, wherein the second voltage multiplier circuit is a high voltage tandem flyback circuit.

* * * * *